US006075355A

United States Patent [19]

Filoramo et al.

[11] Patent Number: 6,075,355

[45] Date of Patent: Jun. 13, 2000

[54] CURRENT MIRROR CIRCUIT WITH RECOVERY, HAVING HIGH OUTPUT IMPEDANCE

[75] Inventors: Pietro Filoramo, Siracusa; Gaetano Cosentino; Giuseppe Palmisano, both of Catania, all of Italy

[73] Assignee: STMicroelectronics S.r.l., Agrate Brianza, Italy

[21] Appl. No.: 09/400,774

[22] Filed: Sep. 22, 1999

[30] Foreign Application Priority Data

Sep. 25, 1998 [IT] Italy ..... MI98A2076

[51] Int. Cl.[7] ..... G05F 3/16

[52] U.S. Cl. ..... 323/315

[58] Field of Search ..... 323/312, 313, 323/314, 315

[56] References Cited

U.S. PATENT DOCUMENTS 4,524,318 6/1985 Burnham et al. ..... 323/313

4,584,535 4/1986 Seevinck ..... 323/316

5,391,981 2/1995 Masson ..... 323/316

*Primary Examiner*—Adolf Deneke Berhane

*Assistant Examiner*—Gary L. Laxton

*Attorney, Agent, or Firm*—Theodore E. Galanthay; Allen, Dyer, Doppelt, Milbrath & Gilchrist, P.A.

[57] ABSTRACT

A current mirror circuit is provided with recovery having high output impedance. The current mirror includes a differential stage having a pair of transistors, and a voltage feedback loop which is stabilized and closed on a first one of the transistors of the differential stage. A second one of the transistors of the differential stage is connected, by its base terminal, to the collector terminal of an output transistor and, by its collector terminal, to the supply voltage. Moreover, the circuit includes a positive feedback loop which has the second transistor of the differential stage and the output transistor. A low-impedance circuit branch is connected to the base terminal of the second transistor of the differential stage and to the collector terminal of the output transistor.

31 Claims, 1 Drawing Sheet

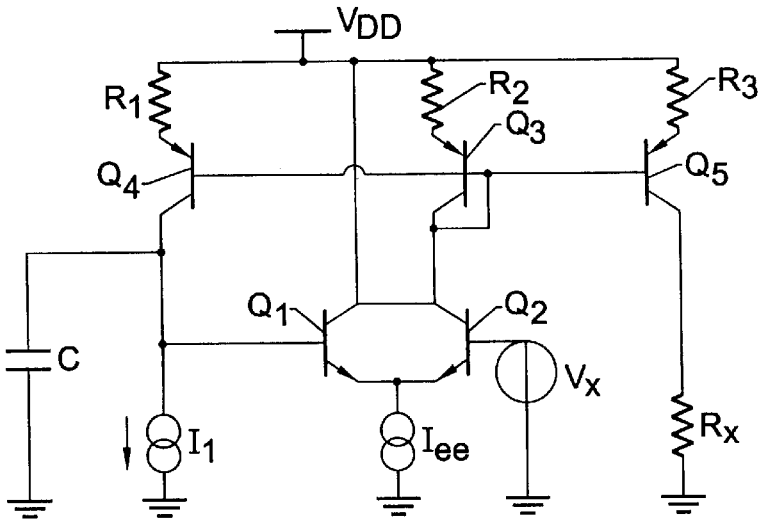
FIG. 1.
(PRIOR ART)
FIG. 2.
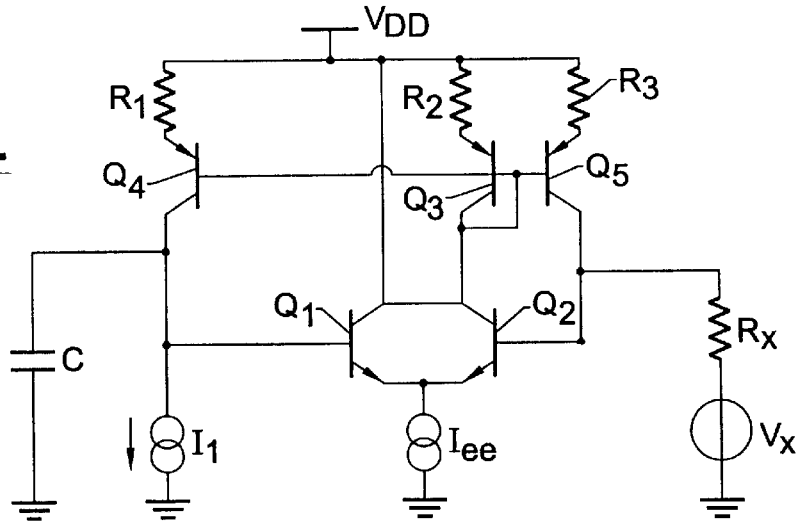
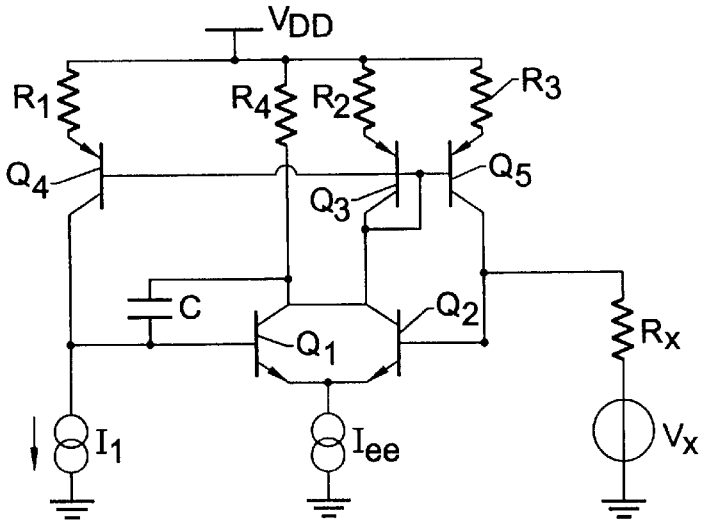
FIG. 3.

CURRENT MIRROR CIRCUIT WITH RECOVERY, HAVING HIGH OUTPUT IMPEDANCE

FIELD OF THE INVENTION

The present invention relates to current mirror circuits, and more particularly, to current mirror circuits with recovery, having high output impedance.

BACKGROUND OF THE INVENTION

It is known that in current integrated circuits the requirements for precision in transferring electrical values are becoming increasingly stringent. This leads to the need to provide circuits whose functionality characteristics are ever closer to those of ideal components.

FIG. 1 illustrates a conventional current mirror circuit which is formed by a differential pair of transistors $Q_1$ and $Q_2$ which have common-connected emitter terminals biased by a current Iee. Transistors $Q_3$ and $Q_4$ are further provided in order to form a feedback loop formed by the transistors $Q_1$–$Q_4$. The transistor $Q_4$ is connected, by its emitter terminal, to the supply voltage with a resistor $R_1$ interposed; likewise, the transistor $Q_3$ is connected, by its emitter terminal, to the supply voltage $V_{DD}$ with a resistor $R_2$ interposed and its collector terminal is common-connected to the collector terminal of the transistor $Q_2$. The collector terminal of the transistor $Q_3$ is further connected to its base terminal, which is connected to the base terminal of the transistor $Q_4$.

In the transistor $Q_1$, the collector terminal is instead connected to the supply voltage. The transistor $Q_4$ receives in input a current I1 and has a capacitor C parallel-connected to it in order to stabilize the feedback. An output branch, constituted by a transistor $Q_5$, is connected in parallel to the branch formed by the differential pair $Q_1$ and $Q_2$. In particular, in the transistor $Q_5$ the emitter terminal is connected to the supply voltage $V_{DD}$, with a resistor $R_3$ interposed, the base terminal is connected to the base terminals of the transistors $Q_3$ and $Q_4$, and the collector terminal is connected to the ground by a resistor Rx.

The above-described circuit solution is affected by drawbacks due to the current mirror circuit having a low output resistance and is further affected by transfer errors, i.e., mirroring errors, because the base current of the transistor $Q_1$ can be different from the base current of the transistor $Q_2$ and therefore can cause the current mirroring on the transistor $Q_5$ to be inaccurate. Another source of error is due to the differences in the Early voltage between the transistors $Q_4$ and $Q_5$ and specifically to the voltage differences between the collector-emitter voltage of the transistor $Q_4$ and the collector-emitter voltage of the transistor $Q_5$.

SUMMARY OF THE INVENTION

An object of the present invention is to provide a current mirror circuit with recovery which allows high precision in current mirroring, greatly reducing transfer errors between the input and the output of the circuit.

Another object of the present invention is to provide a current mirror circuit with recovery which substantially allows the elimination of the errors due to the base current of the differential stage and to Early voltage differences.

A further object of the present invention is to provide a current mirror circuit with recovery which permits a high output impedance.

Still a further object of the present invention is to provide a current mirror circuit with recovery which is highly reliable, relatively easy to manufacture and at competitive costs.

These objects and others which will become apparent hereinafter are achieved by a current mirror circuit with recovery having high output impedance, comprising a differential stage which includes a pair of transistors, and a voltage feedback loop which is stabilized and closed on a first one of the transistors of the differential stage. A second one of the transistors of the differential stage is connected, by its base terminal, to the collector terminal of an output transistor and, by its collector terminal, to the supply voltage. The current mirror circuit comprises a positive feedback loop which includes the second transistor of the differential stage and the output transistor. A low-impedance circuit branch is connected to the base terminal of the second transistor of the differential stage and to the collector terminal of the output transistor.

BRIEF DESCRIPTION OF THE DRAWINGS

Further characteristics and advantages will become apparent from the following detailed description of preferred but not exclusive embodiments of the circuit according to the invention, illustrated only by way of non-limitative example in the accompanying drawings, wherein:

FIG. 1 is a circuit diagram of a conventional current mirror circuit;

FIG. 2 is a circuit diagram of a first embodiment of a current mirror circuit according to the present invention; and FIG. 3 is a circuit diagram of a second embodiment of the current mirror circuit according to the present invention.

DETAILED DESCRIPTION OF THE PREFERRED EMBODIMENTS

The invention will now be described with reference to FIGS. 2 and 3, wherein the reference numerals in common with FIG. 1 designate corresponding elements. The current mirror circuit according to the present invention, illustrated in FIG. 2, comprises circuit elements which are arranged in a similar manner with respect to the ones shown in FIG. 1.

The specifics of the invention include the provision of a positive feedback loop determined by the transistors $Q_2$, $Q_3$ and $Q_5$, because the collector terminal of the transistor $Q_5$ is connected to the base terminal of the transistor $Q_2$ and to a low-impedance branch constituted by a voltage source Vx which is series-connected to a resistor Rx. Alternatively, the transistor $Q_3$ may be omitted and in this case the collector terminal of the transistor $Q_2$ is directly connected to the resistor $R_2$.

The two transistors that constitute the differential stage, $Q_1$ and $Q_2$, permit an output current on the transistor $Q_3$ which is in phase with respect to $Q_2$ and in antiphase with respect to $Q_1$. The transistor $Q_4$ allows to close a voltage loop on $Q_1$. The above-described structure can be considered as an operational amplifier closed in a follower configuration. The capacitor C is meant to ensure the stability of the voltage loop. The feedback equalizes the collector current of the transistor $Q_4$ with the current I1 and in turn becomes the collector current of the transistor $Q_5$.

Mirroring precision is in turn determined by the error due to the base current of the differential stage, which can be balanced by ensuring that the differential pair $Q_1$, $Q_2$ operates in the region in which the differential voltage is approximately zero, so as to make the base currents of the transistors $Q_1$ and $Q_2$ practically equal. The other error source, as mentioned in the discussion of the prior art, is due to the Early voltage differences between $Q_4$ and $Q_5$, but due to the positive feedback comprised of the loop formed by the transistors $Q_3$, $Q_5$ and $Q_2$, this difference is practically eliminated. The collector of the transistor $Q_5$, in view of the current output, is actually connected to a low-impedance circuit, represented by the voltage source Vx and by the resistor Rx. Precision is therefore linked to the variation in current between the transistors $Q_5$ and $Q_4$, which is approximately equal to the Early voltage variation between said transistors, which is approximately equal to zero.

The above-described circuit is very useful for example when there are voltage transients on Vx or variations in the current of Vx which have the effect of modulating the voltage of the transistor $Q_5$. Due to the positive feedback loop, this variation is also applied to the transistor $Q_4$, thus eliminating the difference of the Early voltages. In view of the positive feedback loop determined by the transistors $Q_2$, $Q_3$ and $Q_5$, it is necessary to ensure that there is always a low impedance on the collector of the transistor $Q_5$, so that the gain of the loop being considered is lower than 1. The difference of the voltages between the collector and the emitter of the transistors $Q_4$ and $Q_5$ is thus eliminated by the positive feedback loop (formed by the transistors $Q_2$, $Q_3$ and $Q_5$), since the base voltage of the transistor $Q_1$ follows the base voltage of the transistor $Q_2$.

In practice it has been observed that the circuit according to the present invention fully achieves the intended objects, since it provides a current mirror circuit with double feedback which as such provides a very high output impedance. The circuit thus described is susceptible to numerous modifications and variations, all of which are within the scope of the inventive concept. Thus, for example, the transistors employed in the circuit according to the invention, shown as bipolar transistors in FIG. 2, can also be replaced with MOS transistors.

A further embodiment of the circuit of FIG. 2 is shown in FIG. 3, in which the stabilization capacitor C is connected between the base terminal of the transistor $Q_1$ and the collector terminal of the transistor. A resistor $R_4$ is provided between the collector terminal of the transistor $Q_1$ and the supply voltage. All the details may also be replaced with other technically equivalent elements.

The disclosure in Italian Patent Application No. MI98A002076 from which this application claims priority is incorporated herein by reference.

What is claimed is:

1. A current mirror circuit with recovery having high output impedance, comprising:

a differential stage including a pair of transistors, and a voltage feedback loop which is stabilized and closed on a first one of the pair of transistors;

an output transistor having a collector terminal connected to a base terminal of a second one of the pair of transistors;

a supply voltage connected to a collector terminal of the second one of the pair of transistors; and a low-impedance circuit branch connected to the base terminal of the second one of the pair of transistors and to the collector terminal of the output transistor;

the second one of the pair of transistors and the output transistor defining a positive feedback loop.

2. The current mirror circuit according to claim 1, wherein the collector terminal of the second one of the pair of transistors is connected to the supply voltage via a diode-connected transistor.

3. The current mirror circuit according to claim 1, wherein the output transistor is connected to the supply voltage via a resistor.

4. The current mirror circuit according to claim 1, wherein the low-impedance circuit branch comprises a voltage source and a resistor connected in series.

5. The current mirror circuit according to claim 1, further comprising an additional transistor connected between the supply voltage and ground, wherein the first one of the pair of transistors and the additional transistor define the voltage feedback loop.

6. The current mirror circuit according to claim 5, further comprising a capacitor for stabilizing the voltage feedback loop and being connected between ground and a collector terminal of the additional transistor.

7. The current mirror circuit according to claim 5, further comprising:

a capacitor for stabilizing the voltage feedback loop and being connected between a base terminal and a collector terminal of the first one of the pair of transistors; and a resistor being connected between the collector terminal of the first one of the pair of transistors and ground.

8. The current mirror circuit according to claim 1, wherein the pair of transistors and the output transistor are bipolar transistors.

9. The current mirror circuit according to claim 1, wherein the pair of transistors and the output transistor are MOS transistors.

10. A current mirror circuit comprising:

a differential stage including first and second transistors and a voltage feedback loop;

an output transistor having a collector terminal connected to a base terminal of the second transistor;

a supply voltage connected to a collector terminal of the second transistor; and a low-impedance circuit branch connected to the base terminal of the second transistor and to the collector terminal of the output transistor.

11. The current mirror circuit according to claim 10, wherein the second transistor and the output transistor define a positive feedback loop.

12. The current mirror circuit according to claim 10, wherein the voltage feedback loop is stabilized and closed on the first transistor.

13. The current mirror circuit according to claim 10, further comprising a third transistor connected as a diode and connected between the collector terminal of the second transistor and the supply voltage.

14. The current mirror circuit according to claim 10, further comprising a resistor connected between the output transistor and the supply voltage.

15. The current mirror circuit according to claim 10, wherein the low-impedance circuit branch comprises a voltage source and a resistor connected in series.

16. The current mirror circuit according to claim 10, further comprising a fourth transistor connected between the supply voltage and ground, wherein the first transistor and the fourth transistor define the voltage feedback loop.

17. The current mirror circuit according to claim 16, further comprising a capacitor for stabilizing the voltage feedback loop and being connected between ground and a collector terminal of the fourth transistor.

18. The current mirror circuit according to claim 16, further comprising:

a capacitor for stabilizing the voltage feedback loop and being connected between a base terminal and a collector terminal of the first transistor; and a resistor being connected between the collector terminal of the first transistor and ground.

19. The current mirror circuit according to claim 10, wherein the first, second and output transistors are bipolar transistors.

20. The current mirror circuit according to claim 10, wherein the first, second and output transistors are MOS transistors.

21. A method of making a current mirror circuit comprising the steps of:

providing a differential stage including first and second transistors and a voltage feedback loop;

connecting a collector terminal of an output transistor to a base terminal of the second transistor;

connecting a collector terminal of the second transistor to a supply voltage; and connecting the base terminal of the second transistor and the collector terminal of the output transistor to a low-impedance circuit branch.

22. The method according to claim 21, wherein the second transistor and the output transistor define a positive feedback loop.

23. The method according to claim 21, wherein the voltage feedback loop is stabilized and closed on the first transistor.

24. The method according to claim 21, further comprising the step of connecting a third transistor, connected as a diode, between the collector terminal of the second transistor and the supply voltage.

25. The method according to claim 21, further comprising the step of connecting a resistor between the output transistor and the supply voltage.

26. The method according to claim 21, wherein the low-impedance circuit branch comprises a voltage source and a resistor connected in series.

27. The method according to claim 21, further comprising the step of connecting a fourth transistor between the supply voltage and ground, wherein the first transistor and the fourth transistor define the voltage feedback loop.

28. The method according to claim 27, further comprising the step of connecting a capacitor between ground and a collector terminal of the fourth transistor to stabilize the voltage feedback loop.

29. The method according to claim 27, further comprising the steps of:

connecting a capacitor between a base terminal and a collector terminal of the first transistor to stabilize the voltage feedback loop; and connecting a resistor between the collector terminal of the first transistor and ground.

30. The method according to claim 21, wherein the first, second and output transistors are bipolar transistors.

31. The method according to claim 21, wherein the first, second and output transistors are MOS transistors.

* * * * *

UNITED STATES PATENT AND TRADEMARK OFFICE

CERTIFICATE OF CORRECTION

PATENT NO. : 6,075,355

DATED : June 13, 2000

INVENTOR(S) : Pietro Filoramo, et. al.

It is certified that error appears in the above-identified patent and that said Letters Patent is hereby corrected as shown below:

Drawings, Fig. 1 — Delete: " Fig. 1" Insert --Fig. 1-

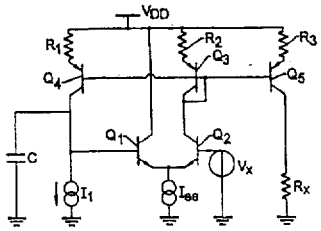

FIG. 1.
(PRIOR ART)

Drawings, Fig. 2 — Delete: "Fig. 2" Insert --Fig. 2--

FIG. 2.

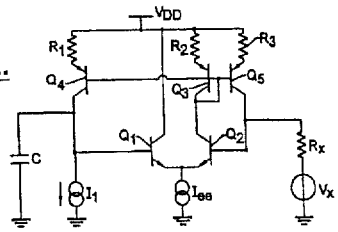

Drawings, Fig. 3 — Delete: "Fig. 3" Insert --Fig. 3--

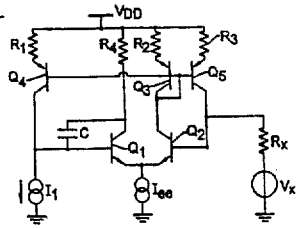

FIG. 3.

Signed and Sealed this

Twenty-second Day of May, 2001

Nicholas P. Godici

*Attest:*

NICHOLAS P. GODICI

*Attesting Officer*

*Acting Director of the United States Patent and Trademark Office*